United States Patent [19]

Greenlee et al.

[11] Patent Number: 4,791,992

[45] Date of Patent: Dec. 20, 1988

[54] HYDRAULICALLY OPERATED AND RELEASED ISOLATION PACKER

[75] Inventors: Donald R. Greenlee, Cedar Hill; Michael W. Pitts, Midland, both of Tex.

[73] Assignee: Dresser Industries, Inc., Dallas, Tex.

[21] Appl. No.: 86,569

[22] Filed: Aug. 18, 1987

[51] Int. Cl.[4] ..... E21B 33/128; E21B 33/13

[52] U.S. Cl. ..... 166/387; 166/187; 166/196

[58] Field of Search ..... 166/187, 120, 122, 387, 166/196

[56] References Cited

U.S. PATENT DOCUMENTS

| | | | |
|---|---|---|---|
| 2,178,844 | 11/1939 | Baker | 166/187 X |
| 3,122,205 | 2/1964 | Brown et al. | 166/120 X |
| 3,221,818 | 12/1965 | Taylor et al. | 166/187 X |
| 3,282,342 | 11/1966 | Mott | 166/120 |
| 4,349,071 | 9/1982 | Fish | 166/124 |
| 4,401,158 | 8/1983 | Spencer et al. | 166/51 |
| 4,487,258 | 12/1984 | Jackson et al. | 166/120 |

*Primary Examiner*—Stephen J. Novosad

*Attorney, Agent, or Firm*—Jerry R. Selinger; Edward G. Fiorito; William R. Peoples

[57] ABSTRACT

Disclosed is a packer (32) responsive to a first hydraulic pressure for setting the packer (32) within a casing (16), and responsive to a second higher pressure for releasing the packer (32) from the casing (16). The first pressure moves an inner piston (94) which shears a screw (96) to thereby apply a compressive force to elastomeric bands (66, 68). The elastomeric bands (66, 68) bow outwardly and seal the packer (32) to the casing (16). A toothed ratchet ring (135) engages with respective teeth (114,122) of the inner piston (94) and an outer cylinder piston (90) to permit one-way movement of the inner piston (94). The packer (32) is thereby set and the hydraulic pressure can be reduced. The packer (32) is released from its sealing engagement with the casing (16) by applying a second greater hydraulic pressure which shears a screw (92), thereby allowing the outer cylindrical piston (90) to move downwardly. The inner piston (94) also moves downwardly, thereby removing the compressive force applied to the elastomeric bands (66, 68) and thus releasing the packer (32) from the casing (16).

38 Claims, 3 Drawing Sheets

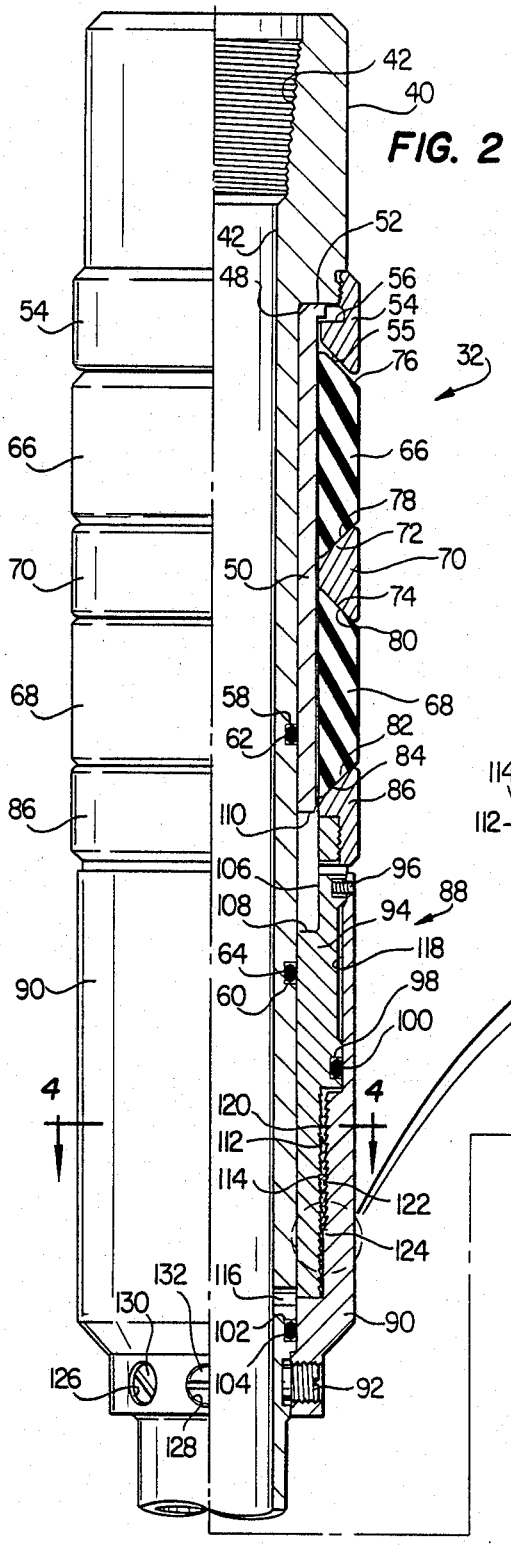
FIG. 2
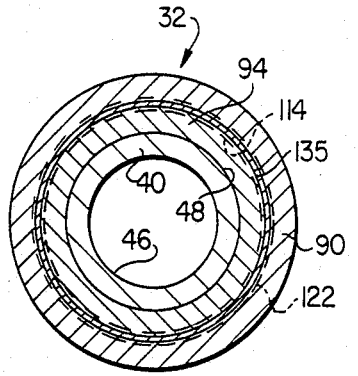
FIG. 4
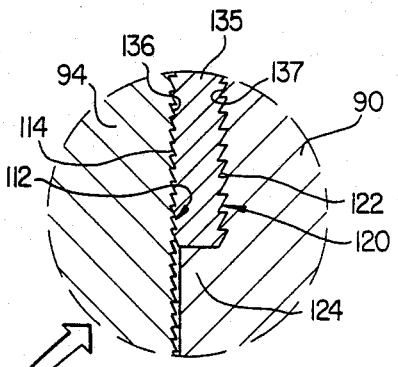
FIG. 3
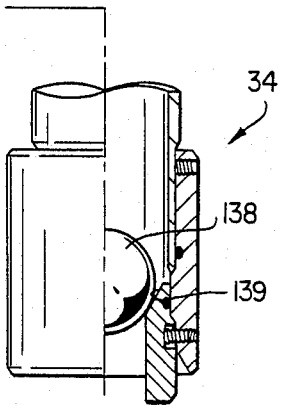

HYDRAULICALLY OPERATED AND RELEASED ISOLATION PACKER

TECHNICAL FIELD OF THE INVENTION

The present invention relates in general to methods and apparatus utilized in the extraction of hydrocarbons from subterranean formations, and more particularly relates to methods and apparatus for isolating regions of a well casing to improve hydrocarbon production.

BACKGROUND OF THE INVENTION

After a hydrocarbon deposit has been drilled, a production casing is installed, and then perforated at desired areas to allow hydrocarbons in the earth to enter the casing and be extracted upwardly to the surface. The perforated casing prevents the well from eroding or deteriorating, as well as allows the hydrocarbon to pool therein so that the minerals can be pumped, or otherwise extracted.

Production casings are generally perforated with groups of holes encircling the casing, such groups being located along the axis of the riser where hydrocarbon formations are expected to be found. During exploration and drilling, the location and depth of such formations can be accurately determined. The production characteristics of the subterranean formation may change over time, necessitating the closing off of the hydrocarbon inflow of certain formation levels. For example, it is often desirable to block off perforated casing areas near formation levels where there is an influx of sand or other contaminating material. Also, the hydrocarbon material at such levels may run out and be replaced with water.

In order to close off such areas or zones of the production casing and avoid the influx of such contamination, packing equipment is utilized. A packer is essentially apparatus which can be installed at any point within the casing for shutting off the hydrocarbon flow therein, except through a crossover passageway which allows hydrocarbons from lower formations to pass through the blocked off area. In order to isolate a perforated zone, an upper and lower packer are utilized for providing a seal to the production casing above and below the perforated zone. A crossover extends through the packers and is sealed thereto In this manner, the perforated zone of the casing is isolated from the remaining part of the production casing, thereby allowing hydrocarbons to be produced from below the packers, forced through the crossover, and to surface equipment.

Isolation packers are well known in the art for accomplishing the noted functions. U.S. Pat. No. 4,401,158, for example illustrates a multi-zone gravel packer for isolating desired zones of a production casing and packing the same with gravel. While the packer of the noted patent is effective to install several levels of packers with only a single trip of the drill string, there are no provisions for removing the packers from the casing, or for moving the packers from one location in the casing to another. Packers constructed according to the noted patent have an inherent disadvantage, in that in order to retrieve the lower hydraulically set packer, the tubing string must be disconnected from the uppermost mechanically set packer, and a shifting tool inserted for releasing the lower packer.

Mechanically set packers utilizing slips can also be employed as both upper and lower packers for isolating perforated zones of a production casing. A retrievable packer utilizing slips is expensive due to the complexity thereof. Also, mechanically settable and releasable packers have a tendency to hang up in the casing perforations, thereby resulting in damage to the packer or to the well casing during removal of the packer.

Cup-type packers provide yet another alternative in isolating zones of a production riser. Cup-type packers are not expandable or retractable under an operator's control, and thus remain in continual contact with the inside surfaces of the production casing. Thus, when such cup-type packers are forcibly moved in the casing, such as during installation or removal, the cups become worn and often damaged when forced past the perforations or coupling joints of the casing. When such packers become excessively worn or torn, an undesired leakage of fluids may occur from one casing zone to another. Moreover, when employing cup-type packers, a quantity of fluid must be pushed by the cups in the same direction that the tubing string is moved, which fluid may be forced through the perforated zones back into the formation as the tubing string is pushed into the well, or fluid is slubbed from the casing as the tubing string is pulled from the well.

From the foregoing, it can be seen that a need exists for an improved packer which requires no slips, is hydraulically set and hydraulically released, and thus can be efficiently installed or removed from the production casing. An associated need exists for packing apparatus which is not unduly complicated, thus facilitating manufacture thereof and resulting in a cost effective and reliable product.

SUMMARY OF THE INVENTION

In accordance with the present invention, the disclosed packer apparatus and method of packing reduces or substantially eliminates the disadvantages and the shortcomings associated with the prior art techniques. The hydraulically operated isolation packer of the invention includes a mandrel fixed to a tubing string for lowering within the production casing to a desired location. One or more elastomeric bands encircle the mandrel, and are radially expandable in response to an axial compressive force for sealing the packer to the inside of the casing. A first piston of the dual piston assembly, in the nature of a cylinder surrounding the mandrel, is releasably fixed by a shear pin to the mandrel. A second piston of the dual piston assembly is disposed between the mandrel and the first piston, and sealed therebetween by O-rings, or the like. The second piston is releasably fixed to the first piston by a smaller shear pin. The first and second pistons are arranged to move in a telescopic manner.

The first piston and second piston each include engaging members comprising respectively inner and outer downwardly angled annular teeth. Disposed between the annular teeth of the pistons is a cylindrical ratchet ring having inner and outer upwardly angled teeth. The ratchet ring functions to allow the second piston to move in one direction, but is prevented from moving in the other direction. A fluid port is formed through the sidewall of the mandrel so that when the fluid pressure in the mandrel reaches a certain pressure, the smaller shear pin is sheared, whereupon the second piston is moved along the mandrel and applies the compressive force to the elastomeric bands for expanding such bands and achieving a seal to the casing. The ratchet ring prevents backward movement of the second piston. The first piston and the second piston are thereby locked together and the packer is hydraulically set in the casing, irrespective of the pressure which thereafter may exist in the mandrel.

For hydraulically releasing the packer, an increased fluid pressure is coupled to the mandrel. The increased pressure is sufficient such that the force on the larger shear pin connecting the first piston to the mandrel is sheared. The first and second pistons are then no longer engaged with the mandrel, whereupon they fall and allow the elastomeric bands to fully contract. The packer can then be removed from the casing.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements throughout the views, and in which:

FIG. 2 is a partial sectional view of the isolation packer of the invention with the parts thereof shown in relative positions for lowering into a production casing;

FIG. 3 is an enlarged sectional view of a portion of FIG. 2, illustrating the details of the ratchet ring for allowing ratchet movement of the second piston with respect to the first piston;

FIG. 4 is a sectional view of the isolation packer of the invention, taken along line 4—4 of FIG. 2;

DETAILED DESCRIPTION OF THE INVENTION

Figure 1:
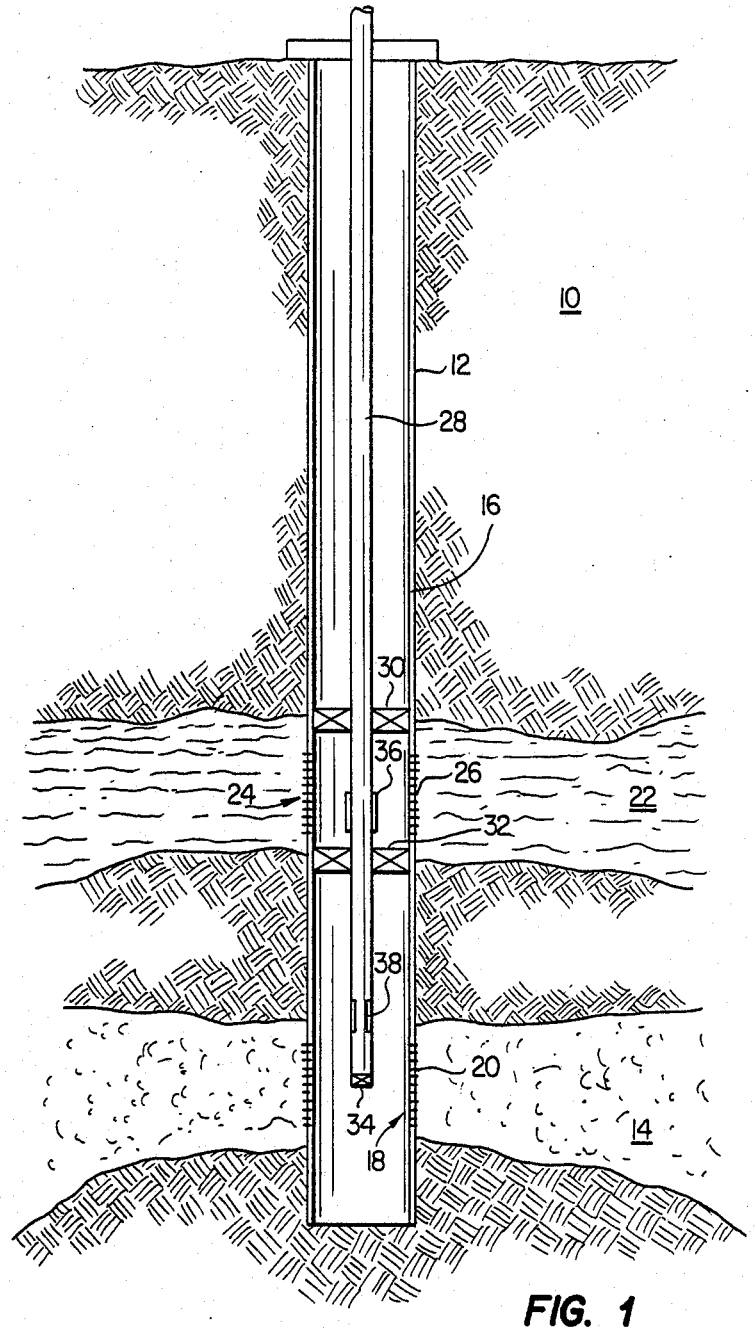
FIG. 1 illustrates an environment in which the present invention may be advantageously practiced.

FIG. 1 illustrates an environment in which the invention may be advantageously practiced. Shown is a portion of the earth's crust 10 in which a wellbore 12 is formed to reach subterranean hydrocarbon deposits, one shown as numeral 14. A casing 16 is installed within the wellbore 12 according to conventional techniques. The casing 12 is perforated at a first zone 18 with a group of individual perforations 20 for allowing the hydrocarbons from formation 14 to enter the casing 16 and be removed upwardly by pumping or other gas-lift techniques. Hydrocarbon formations may be located at various levels, such as also shown by reference character 22. Accordingly, another zone 24 of perforations 26 would be formed in the casing 16 to permit the hydrocarbons at formation level 22 to enter the casing 16.

After a hydrocarbon level, such as 22, becomes depleted, it is often replaced by subterranean water which enters the casing 16. In many cases, nearly depleted hydrocarbon levels produce a majority of water, or very low grade hydrocarbons. Contaminants other than water, such as sand, can also deteriorate the production and/or quality of the hydrocarbons, as well as cause severe wear of the production equipment. In these situations, it is desirable to prevent the inflow of the undesired material without affecting the inflow of hydrocarbons at other levels into the casing, such as zone 18.

In these cases, the casing 16 of the well is packed to thereby block off the zones at which it is desired to prevent formation material from entering the casing 16. FIG. 1 illustrates, in simplified form, a production riser or tubing string 28 extending within the casing 16 for carrying the hydrocarbons from a downhole location to surface equipment (not shown). Also shown is an upper packing apparatus 30 located above the casing zone 24, and a lower packing apparatus 32 located below the casing zone 24. Packers 30 and 32 are sealed to the production riser 28, as well as to the inside surfaces of the casing 16 to thereby isolate the zone 24 from the casing sections located above and below the isolated zone. However, hydrocarbons can flow from the casing zone 18, through the isolated zone 24, and through the riser 28 to the surface equipment.

In practice, the packers 30 and 32 can be run into a well on a tubing string. The packers 30 and 32 are arranged in a spaced-apart manner on the tubing string 28 to block off an area of the casing 16 encompassed by the zone 24. A tubing plug 34 is connected to the bottom of the tubing string 28 to function as a check valve, allowing fluid flow upwardly through the string 28, but preventing fluid flow in the opposite direction. The tubing plug 34 may be of conventional design, such as a ball disposed above a seat. The top packer 30 may in certain instances be a mechanical-type packer set into the casing 16 above the first zone 24. The ball is then dropped down the tubing string 28 to function as a check valve 34. Alternatively, a wireline plug can be employed to function as the check valve 34.

The lower packer 32 is of the hydraulically operated type which is responsive to hydraulic pressure for activation thereof to seal the production riser 28 to the inside surface of the casing 16 below the zone 24. The production riser 28 may be fitted with a wireline valve 36 disposed within casing zone 24 to thereby allow fluid within such zone to enter the production riser 28 and be brought to the surface for inspection or disposal thereof. Fluids can also be pumped from the surface through the open valve 36 and into the formation 22 to plug the inflow of material. In addition, the production riser 28 may be fitted with a sleeve valve 38 for allowing hydrocarbons from zone 18 to freely enter into the production riser 28. Valves 36 and 38 are both selectively operable by surface-located equipment.

As will be described in more detail below the hydraulically operated packer 32 is responsive to a first fluid pressure within the production riser 28 to set such packer 32 at a desired location within the casing 16. After being set, the packer 32 remains sealed to the casing 16, irrespective of the pressure which may thereafter exist within the production riser 28. In order to release the hydraulically operated packer 32, a second pressure, greater than the first pressure, is applied to the production riser 28, whereupon the hydraulically operated packer 32 is released from its sealing engagement with the casing 16. Hence, the packer 32 can be released without removing the production riser 28, and without utilizing additional conventional packing extraction equipment. The packer 32 is both set and released by closing the sleeve valve 38 so that the surface-mounted equipment can pressurize the production riser 28. The check valve 34 prevents the pressure within the riser 28 from being released within the casing 16 at zone 18.

With reference now to FIG. 2, there is depicted the hydraulically operated isolation packer constructed in accordance with the preferred embodiment of the invention. The isolation packer 32 includes a mandrel 40 with an upper internally threaded part 42 adapted for coupling to the production riser 28. Formed on the bottom of the mandrel 40 are a set of external threads 44 for coupling to a production riser section or a check valve 34 located therebelow. The mandrel 40 is constructed of tool steel having a tensile strength suitable for supporting the weight of production equipment suspended therefrom.

Further, the mandrel 40 includes a bore 46 for communicating fluids therethrough. The bore 46 functions as a crossover for allowing fluids to pass through the packer 32. The mandrel 40 includes a reduced diameter section 48 extending from near the top to the bottom thereof for receiving thereon a cylindrical shell 50. The shell 50 includes an upper annular outturned flange 52. An internally threaded thimble 54 includes a shoulder 56 operative to capture the flange 52 of the shell 50 when the thimble 54 is secured to a threaded part of the mandrel 40. The mandrel 40 further includes a pair of annular grooves 58 and 60 for receiving therein respective sealing O-rings 62 and 64. O-ring 62 provides a high-pressure seal between the mandrel 40 and the shell 50.

A pair of elastomeric bands 66 and 68 are disposed around the cylindrical shell 50. The bands 66 and 68 are separated by a floating spacer 70 having surfaces 72 and 74 tapered inwardly toward the mandrel 40. Each elastomeric band 66 and 68 is constructed with respective upper and lower surfaces 76, 78 and 80, 82 which are tapered inwardly away from the mandrel 40. As can be seen. elastomeric band 66 has upper and lower surfaces 76 and 78 captured by the respective thimble tapered edge 55 and the floating spacer tapered edge 78. In like manner, the elastomeric band 68 is captured between the bottom tapered surface 74 of the floating spacer 70 and the inwardly tapered surface 84 of a bottom thimble 86. The spacer 70 is also annular in shape and adapted for moving freely along the shell 50.

Importantly, any compressive force applied axially to the elastomeric bands 66 and 68 is effective to bulge or bow such bands outwardly to thereby perfect a seal to the internal sidewalls of the casing 16. The angled nature of the elastomeric bands 66 and 68, together with the corresponding angled nature of the thimbles 54 and 86, and the spacer 70, maintain the upper and lower annular edges of such bands sealed to the shell 50, while the intermediate sections of the bands can bow outwardly.

While the preferred embodiment of the invention contemplates the use of a pair of elastomeric bands 66 and 68, those skilled in the art may find that in certain applications one such band may suffice, while in another application more elastomeric bands will be required. The elastomeric bands are constructed of a conventional type of rubber which is resistant to corrosion and deterioration by the hydrocarbons or chemicals injected into the well. In the preferred form of the invention the elastomeric bands 66 and 68 are about six inches wide and about one inch thick. The angled annular edges of the bands 66 and 68 are tapered to about 45°. The thimbles 54 and 86 and the floating spacer 70 are comparably angled for cooperating with the corresponding edges of the elastomeric bands. The seal assembly can be assembled by first placing the top thimble 54 on the shell 50 and then stretching the top band 66 on the shell. The floating spacer 70 is next placed on the shell 50, followed by the lower band 68. The seal assembly can then be assembled at a later time on the reduced diameter body 48 of the mandrel 40.

The isolation packer 32 further includes a dual-piston assembly 88. The piston assembly 88 includes a first outer cylinder piston 90 releasably fixed to the mandrel 40 by a large shear screw 92. A second piston 94 is also constructed as an inner cylinder add is releasably fixed to the first piston 90 by a smaller shear screw 96. The upper end of the inner piston 94 is threaded for receiving thereon the thimble 86. With this arrangement, when the inner piston 94 is forced upwardly, the elastomeric bands 66 and 68 are compressed and caused to expand outwardly for sealing engagement with the casing 16.

The O-ring 64 is effective to form a seal between the inner piston 94 and the mandrel 40 when said inner piston 94 slides upwardly on the reduced diameter body portion 48 of the mandrel 40. The inner piston 94 further includes an annular groove 98 for receiving therein an O-ring 100 for sealing the inner piston 94 to the outer cylinder piston 90. Formed within the reduced diameter body 48 of the mandrel 40 is yet another annular groove 102 for receiving therein an O-ring 104 for sealing the outer cylinder piston 90 to the reduced diameter body part 48 of the mandrel 40.

With particular reference to the piston assembly 88, the inner piston 94 has formed therein an upper annular recessed area 106 so that when such piston 94 moves upwardly, it can move over the shell 50 until a shoulder 108 defined by the bottom of the piston recess 106 abuts against a corresponding lower edge 110 of the shell 50. On its lower end, the inner piston 94 includes an outer recessed area 112 having a number of annular teeth 114, angled downwardly.

A fluid port 116 formed through the sidewall of the reduced diameter body part 48 of the mandrel 40 communicates fluid pressure from within the mandrel bore 46 to the lower edge of the inner piston 94. It will be described in detail below the manner in which fluid pressure is communicated through the port 116 to operate the inner piston to actuate the elastomeric bands 66 and 68. Another fluid, at greater pressure, is communicated through the port 116 to actuate the outer cylinder piston 90 to release the piston assembly 88 from the mandrel 40, thereby allowing the bands 66 and 68 to relax.

The outer cylinder piston 90 includes an upper inside recessed section 118 encircling a portion of the inner piston 94. Formed internally on the lower half of the outer cylinder piston 90 is another recessed area 120 having a number of annular teeth 122, angled downwardly. The annular teeth 122 of the outer cylinder piston 90 are larger and more coarse than the teeth 114 of the inner piston 94. The outer cylinder piston 90 is further provided with an internal annular shoulder 124, the purpose of which will be explained more fully below. As noted above, the outer cylinder piston 90 is releasably fixed to the mandrel 40 by the shear screw 92. Formed within the bottom portion of the outer cylinder sleeve 90 are a number of other threaded holes 126 and 128 in which shear screws may be secured for releasably fixing the piston 90 to the mandrel 40. Depending on the force desired to release the outer cylinder piston 90 from the mandrel 40, the additional shear screws 130 and 132 may or may not be utilized. In the preferred form of the invention, eight brass shear screws are utilized The size of such brass shear screws are chosen to require a shear force of about 4,000–6,000 pounds to release the outer piston 90 from the mandrel 40.

FIG. 3 is an enlarged sectional view of a portion of the piston assembly 88, illustrating the apparatus for allowing ratcheting movement of the inner piston 94 with respect to the outer cylinder piston 90. Disposed between the inner piston 94 and the outer cylinder piston 90 is a cylindrical ratchet ring 135. The ratchet ring 135 has a number of inner upwardly angled teeth 136 meshing with the downwardly angled teeth 114 of the inner piston 94. Formed on the outside of the ratchet ring 135 are a number of larger upwardly angled teeth 137 meshing with the large teeth 122 of the outer cylinder piston 90. With this arrangement, the inner piston 94 can telescopically slide upwardly with respect to the outer cylinder piston 90, but be prevented from moving in an opposite direction. The inner piston 94 can thereby be locked to the outer cylinder piston 90 by the ratchet ring 135. The downward movement of the ratchet ring 135 is limited by the shoulder 124 of the outer cylinder piston 90.

The ratchet ring 135 is constructed so that its radial resiliency may be adjusted so that only a small downwardly directed force is required to slide the ring downwardly and still lock the ring against sliding upwardly. In practice, the ratchet ring 135 is constructed as a split ring. The ratchet ring 135 is disclosed in detail in U.S. Pat. No. 4,349,071, the disclosure of which is incorporated herein by reference.

FIG. 4 illustrates a sectional view of the isolation packer 32, taken along line 4—4 of FIG. 2. As noted, the outer cylinder piston 90 has a number of internal annular teeth 122. The inner piston 94 is also annular in shape, including outer teeth 114. Disposed between the inner and outer pistons 94 and 90 is the toothed ratchet ring 135 for providing one-way movement of the inner piston 94 with respect to the outer cylinder piston 90. It will be discussed in more detail below the manner in which the ratchet ring 135 cooperates with the inner piston 94 and the outer cylinder piston 90 to provide such one-way movement. The internal cylindrical surface of the inner piston 94 is slideable along the reduced diameter body part 48 of the mandrel 40. Shown also is the bore 46 for carrying fluids through the mandrel 40, and thus through the packer 32.

The hydraulically operated isolation packer 32 of the invention is assembled in the manner depicted in FIG. 2, and secured at its upper end thereof to a surface-directed production riser 28. At its lower end, the mandrel 40 is connected to another section of the riser 28, and terminated with the check valve 34, or other similar functioning device. The check valve 34 is shown with a ball 138 and a seat 139.

The piston assembly 88 is shown in its rest position and thus no compressive force is exerted on the elastomeric bands 66 and 68. Hence, such bands are fully contracted, thereby minimizing the outside diameter of the packer 32. The packer 32 can then be lowered to any desired position within the casing 16, without concern that the elastomeric bands 66 and 68 will be damaged when passing by a perforated area or zone of the casing 16. When the isolation packer 32 has been lowered to the desired position within the casing 16, the valves 36 and 38 are closed if they are not already closed. The ball 138 is then dropped via a wireline into the production riser 28 where it becomes seated within seat 139 of the check valve 34.

The production riser 28 can then be pressurized with a hydraulic fluid to thereby set the isolation packer 32 within the casing 16. This is accomplished by utilizing surface pumping equipment (not shown) and forcing a liquid under pressure down into the production riser 28. Hydraulic pressure is exerted on the inner piston 94 via the mandrel sidewall port 116. However, the initial fluid pressure may not move the inner piston 94 upwardly, as such piston is fixed by the smaller shear screw 96 to the outer cylinder piston 90, which cylinder piston 90 is, in turn, fixed to the mandrel 40 by the larger shear screw 92. Depending on the type and number of smaller shear screws 96 utilized, the hydraulic fluid pressure required to shear such screws 96 and release the inner piston 94 from the outer cylinder piston 90 can be readily calculated. For typical hydrocarbon production applications, the shear force desired to release the inner piston 94 from the outer cylinder piston 90 is about 3,000 pounds. Irrespective of the type of shearing device utilized or screws 96 and 92, for the proper operation of the invention it is necessary that the shearing force associated with the smaller shearing devices 96 is less than that needed to shear the larger devices 92.

In any event, as the hydraulic pressure continues to increase, a level will be reached at which the smaller shear screws 96 are sheared, and the inner piston 94 is forced upwardly The O-rings 64 and 100 are effective to seal an upper portion of the inner piston 94 from leakage of fluid from port 116, while O-ring 104 forms a seal around the bottom end of the outer cylinder piston 90. Pressurized fluid is thus constrained to the area proximate the bottom of the inner piston 94. The forced upward movement of the inner piston 94 also moves the thimble 86 attached thereto upwardly. A compressive force is thus exerted on the lower elastomeric band 68 which, in turn, forces the floating spacer 70 upwardly for exerting a corresponding compressive force on the upper elastomeric band 66. The upper elastomeric band 66 is constrained by the upper thimble 54. Both elastomeric bands 66 and 68 thus undergo a compressive force as a result of the upward movement of the inner piston 94.

Figure 5:
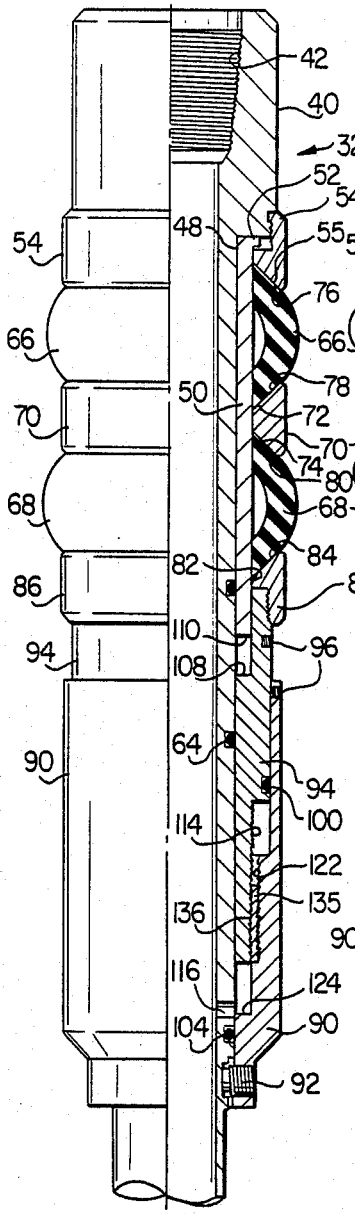
FIG. 5 is a partial sectional view of the isolation packer invention with the parts thereof shown after the fluid pressure has caused upward movement of the second piston and the corresponding expansion of the elastomeric bands.

FIG. 5 illustrates the isolation packer 32 in the state in which the elastomeric bands 66 and 68 are axially compressed. As can be seen, the upper and lower annular edges of each elastomeric band 66 and 68 are maintained in sealing engagement with the shell 50 by being captured thereto with the respective tapered surfaces of the upper and lower thimbles 54 and 86, as well as by the tapered surfaces of the spacer 70. The elastomeric bands 66 and 68 are constructed with a shape and size such that in response to a predetermined axial compressive force, such bands 66 and 68 bow outwardly a known amount. This is necessary to ensure that the elastomeric bands 66 and 68 are forced radially outwardly to achieve a seal with the casing 16 of sufficient quality to withstand desired pressures. For example, if the formation 22 desired to be sealed off is capable of pressurizing the closed off zone 24 to 100 psi, then the elastomeric band 66 and 68 should effect a seal with the casing 16 to withstand at least such, and preferably more, pressure. If a pressure exists on the other side of the isolation packer 32, such as might exist due to the casing pressurization of the hydrocarbon formation 14, then the differential pressure across the isolation packer 32 should be considered.

The hydraulic pressure within the mandrel 40 of the isolation packer 32 is elevated to a predetermined level to assure that the inner piston 94 has moved upwardly a distance sufficient to allow expansion of the elastomeric bands 66 and 68. The inner piston teeth 114 are angled such hat they slip past the angled teeth 136 of the ratchet ring 135. However, the large teeth 137 on the other side of the ratchet ring 135 engage the large teeth 122 of the outer cylinder piston 90, thereby maintaining such parts locked together The hydraulic pressure in the mandrel 40 can then be reduced and the isolation packer 32 remains sealingly engaged to the inner sidewalls of the casing 16. Backward movement of the inner piston 94 is prevented as the small teeth 144 and 136 become engaged. In this condition, the large teeth 122 and 137 are not necessarily lockingly engaged, but downward movement of the ratchet ring 135 is prevented due to the abutment thereof with the shoulder 124 of the outer cylinder piston 90.

Having set the isolation packer 32 utilizing the predetermined hydraulic pressure within the mandrel 40, production from the hydrocarbon formation 14 can then commence by opening the sleeve valve 38. In those situations where it is desired to charge the formation 22 with a liquid or chemical, the sleeve valve 38 can be closed and the wireline valve 36 opened, whereupon a liquid can be pumped from the surface to the isolated zone 24, and thus into the formation 22.

According to an important feature of the invention, the isolation packer 32 can be removed from the casing 16 without the use of specialized packer removal equipment. Also, several isolation packers installed on the production riser 28 can be removed without employing multiple trips of such production riser 28 or other retrieving apparatus. When it is desired to remove the isolation packer 32 which was previously set in accordance with the technique described above, the sleeve valve 38 is again closed, as is the wireline valve 36. The production riser 28 can then again be pressurized, but with a pressure which exceeds the initial pressure required to set the isolation packer 32. This greater pressure is required in order to release the outer cylinder piston 90 from the mandrel 40 by shearing the larger shear screw 92.

Figure 6:
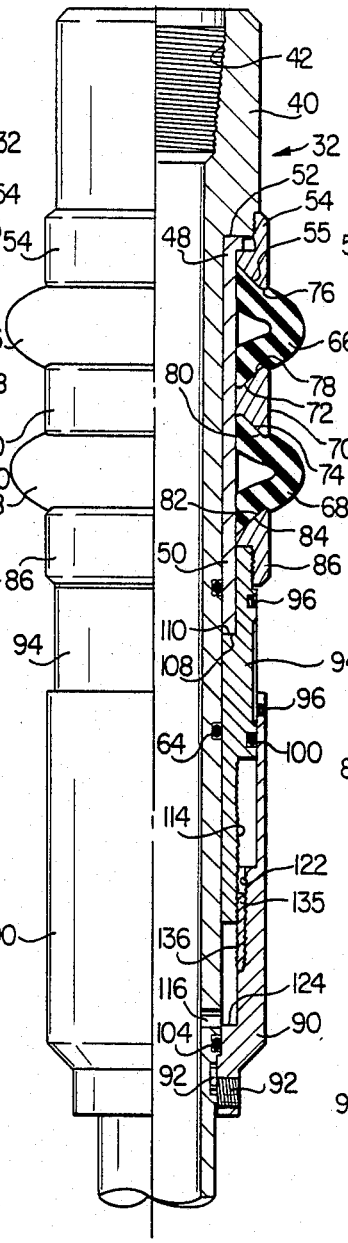
FIG. 6 illustrates a partial sectional view of the isolation packer of the invention after a second greater fluid pressure has been applied to the mandrel, thereby releasing the piston assembly from engagement with the mandrel.
Figure 7:
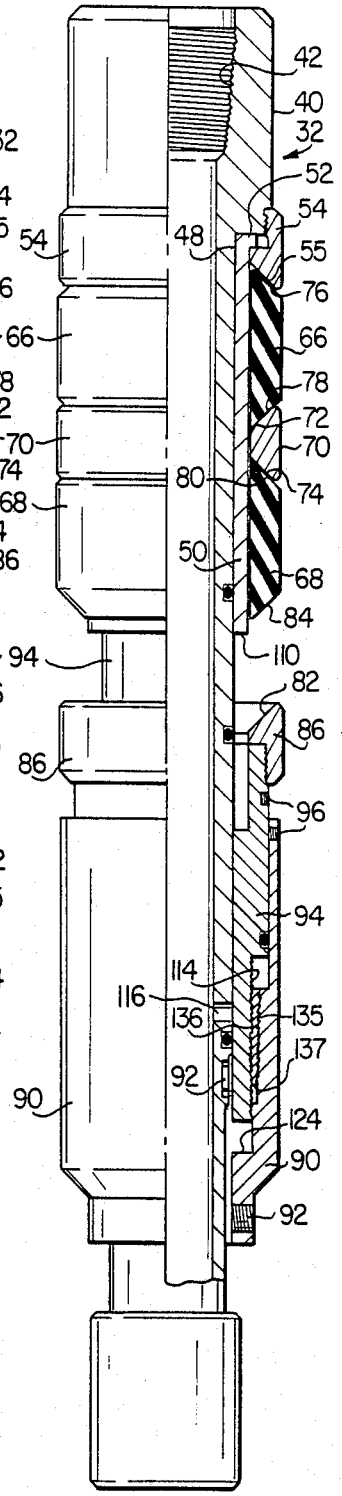
FIG. 7 illustrates a partial sectional view of the isolation packer of the invention with the first and second pistons fully released from the mandrel, thus allowing contraction of the elastomeric bands.

When the pressure within the bore 46 of the mandrel 40 is increased to the predetermined second pressure level, an additional upward force is applied to the inner piston 94. Because further upward movement of the inner piston 94 is allowed by the smaller teeth 114 and 136, such piston is forced further upwardly until the piston shoulder 108 abuts against the shell lower edge 110. The elastomeric bands 66 and 68 are expanded somewhat further outwardly, but are limited due to the engagement of thimble shoulder 108 and shell edge 110. In addition to the upward movement of the inner piston 94, the increased fluid pressure is sufficient to force the outer cylinder piston downwardly and shear the screw 92. The result of this action is depicted in FIG. 6. When the larger shear screw 92 finally gives, the outer cylinder piston 90 is released from its engagement to the mandrel 40. The elasticity of the bands 66 and 68, as well as the force of gravity on the inner piston 94 allows such piston to fall downwardly. The hydraulic fluid pressure forces the outer cylinder piston 90 downwardly until the piston assembly 88 rests on a lower coupling collar. The isolation packer 32 is shown in FIG. 7 with the piston assembly 88 completely released from the mandrel 40. The isolation packer 32 can then be removed from the casing, again without concern that the elastomeric bands 66 and 68 will be damaged or abraided when being pulled through perforated zones of coupling joints of the casing 16.

The isolation packer 32 of the invention can be reused by removing the stubs of the sheared screws 96 and 92, and installing new screws. When re-equipped, the inner piston 94 is again releasably fixed to the outer cylinder piston 90, and the outer cylinder piston 90 is again releasably fixed to the mandrel 40. For resetting the isolation packer 32 within a well casing 16, the inner piston 94 can again be cycled in response to a first pressure to expand the elastomeric bands 66 and 68 and hydraulically set the isolation packer 32 within the casing 16. For removing the packer 32 the pressure within the mandrel 40 is required to again be increased to a higher level to release the cylinder outer piston 90 from the mandrel 40 to allow contraction of the elastomeric bands 66 and 68.

As with the cup-type packer noted above, the isolation packer 32 of the invention can be forcefully removed from the casing 16 without contraction of the elastomeric bands 66 and 68. With this technique, the engagement of the rubber or elastomeric bands with an obstruction in the casing 16, such as with a well casing joints, subjects the packer to possible damage. Certain well-pronounced casing obstructions, such as coupling joints, may cause sufficient mechanical pressure to be applied to the larger shear screws 92, thereby shearing the same and allowing the elastomeric bands 66 and 68 to retract in the manner described above, but without hydraulic pressure.

From the foregoing, an improved isolation packer is disclosed. The isolation packer of the invention is constructed so as to be easily manufacturable, and to be responsive to a first pressure for expanding annular seals for sealing the packer within the casing. When set, the pressure within the packer may be reduced or entirely removed while the packer remains firmly set within the casing. When it is desired to remove the packer from the casing, a second higher pressure is applied thereto, in which event the apparatus becomes operative to release the sealing engagement, thereby allowing the unit to be removed from the casing.

While the preferred embodiment of the invention has been disclosed with reference to a specific isolation packer apparatus and method, it is to be understood that many changes in detail may be made as a matter of engineering choices without departing from the spirit and scope of the invention, as defined by the appended claims.

What is claimed is:

1. A hydraulically operated isolation packer adapted for use in sealing a hydrocarbon production casing, comprising:

a mandrel having a bore therethrough for carrying hydraulic fluids, and a port in said mandrel for carrying said fluids for operating said packer;

elastomeric means encircling said mandrel and adapted to expand in response to a pressure applied thereto for sealing said packer within said production casing;

a piston responsive to a first fluid pressure communicated by said port for moving said piston such that said elastomeric means is expanded; and means for locking said piston such that said elastomeric means remains expanded, said locking means being responsive to a second higher fluid pressure communicated by said port for releasing said piston to thereby allow said elastomeric means to contract and permit movement of said packer within said casing.

2. The isolation packer of claim 1 wherein said locking means comprises a ratchet arrangement for allowing one-way movement of said piston.

3. The isolation packet of claim 1 wherein said elastomeric means is responsive to a compressive force for expanding, and said first piston is responsive to said fluid pressure for compressing said elastomeric means.

4. The isolation packer of claim 1, wherein said piston defines an inner piston, and further including an outer piston operable in response to hydraulic fluid communicated by said port for releasing said inner and outer pistons from a locking engagement with respect to said mandrel and allowing said elastomeric means to contract.

5. The isolation packet of claim 4, wherein said outer piston is releasably fixed to said mandrel with a shear connection which is shearable in response to said second fluid presssure.

6. The isolation packer o claim 5, further including a shearable connection between said inner and outer pistons which shears in response to said first fluid pressure, whereby said first fluid pressure communicated by said port is effective to set said packer and said second fluid pressure communicated by said port is effective to release said packer.

7. A hydraulically operated isolation packer adapted for use in sealing a hydrocarbon production casing, comprising:

a mandrel having a bore therethrough for carrying hydraulic fluids, and movable within said casing to a desired position for isolating regions therein;

elastomeric means encircling said mandrel and adapted to radially expand in response to an axial compressive force applied thereto for sealing said mandrel to said production casing;

a first piston releasably fixed to said mandrel;

a second piston responsive to a first fluid pressure for moving from a rest position to a position for applying said axial compressive force for expanding said elastomeric means;

means for engaging said second piston to said first piston so that said elastomeric means remains expanded in a sealing relationship with said production casing; and means responsive to a second pressure for operating said first piston and for releasing said first piston from said mandrel, and thereby allowing said second piston to be removed from compressive engagement with said elastomeric means.

8. The isolation packer of claim 7 wherein said second piston comprises a cylinder encircling said mandrel, and said first piston is cylindrical and operative to encircle said second cylinder.

9. The isolation packer of claim 8 wherein said engaging means is located between said first piston and said second piston.

10. The isolation packer of claim 7 wherein said engaging means includes external teeth projecting from said second piston and internal teeth projecting from said first piston and a toothed ratchet ring disposed therebetween.

11. The isolation packer of claim 7 wherein said first piston is releasably fixed to said mandrel by a shearable device.

12. The isolation packer of claim 11 wherein said shearable device comprises a set screw threaded into said mandrel.

13. The isolation packer of claim 11 wherein said second piston is releasably fixed to said first piston.

14. The isolation packer of claim 13 wherein said second piston is releasably fixed to said first piston by a shearing device.

15. The isolation packer of claim 14 wherein said shearing device is shearable with a force less than that of said shearable device.

16. The isolation packer of claim 7 wherein said mandrel includes a fluid port in the sidewall thereof for communicating fluid pressure to said second piston and to said first piston.

17. The isolation packer of claim 7 wherein said elastomeric means comprises a pair of elastomeric bands.

18. The isolation packer of claim 7 wherein said elastomeric means comprises an elastomeric band having an upper and lower annular edge each tapered outwardly toward each other, and including means for constraining said upper and lower annular tapered edges against said mandrel.

19. The isolation packer of claim 18 wherein said constraining means includes tapered annular edges mating with the tapered edges of said elastomeric band.

20. The isolation packer of claim 7 further including stop means for .limiting the travel of said second piston in response to fluid pressure so as to limit the compressive force applied to said elastomeric means.

21. A hydraulically operated isolation packer adapted for use in sealing a hydrocarbon production casing, comprising:

a mandrel having a bore therethrough for communicating hydraulic fluid, said mandrel having a fluid port in a sidewall thereof;

a first cylinder piston releasably attachable to said mandrel, said first piston including engaging teeth on an inside surface thereof;

a second piston slideable over said mandrel and disposed generally between said mandrel and said first piston, said second piston having outer engaging teeth;

a ratchet ring having inner and outer teeth engageable respectively with the teeth of said second piston and said first piston, the teeth of said ratchet ring and of said first and second piston being oriented so as to allow said second piston to move in one direction with respect to said first piston, but preventing movement thereof in an opposite direction;

means for releasably fixing said second piston to said first piston;

seal means for sealing said first and second pistons together, and for sealing said first and second pistons to said mandrel to thereby form a chamber about said fluid port;

an annular elastomeric band encircling said mandrel and adapted to radially expand in response to an axial compressive force applied thereto to thereby seal said mandrel to said production casing; and means connected to said second piston and responsive to the movement thereof in said one direction for applying said compressive force to said elastomeric band.

22. The isolation packer of claim 21 wherein said second piston is responsive to a first hydraulic pressure in said chamber for moving in ratchet engagement with said first piston to thereby apply said compressive force to said elastomeric band and set said packer in the casing.

23. The isolation packer of claim 22 wherein said first piston is responsive to a second fluid pressure in said chamber for releasing said first piston from said mandrel and thereby releasing said second piston in ratchet engagement therewith so that the compressive force on said elastomeric band is also released.

24. The isolation packer of claim 22 further including means for releasably fixing said first piston to said second piston and responsive to said first pressure for releasing the fixation of said first, and second pistons.

25. The isolation packer of claim 21 wherein said elastomeric band includes annular tapered edges, and further including thimble means having annular tapered edges engageable with the tapered edges of said elastomeric band for applying a compressive force to said elastomeric band such that an intermediate annular area of said elastomeric band bows outwardly while the annular edges thereof remain engaged in a sealing manner to said mandrel.

26. The isolation packer of claim 25 further including a cylindrical shell disposed around said mandrel and to which said elastomeric band is circumferentially attached.

27. A hydraulically operated isolation packer adapted for use in sealing a hydrocarbon production casing, comprising:

a mandrel having a bore therethrough for communicating hydraulic fluid, said mandrel having a reduced diameter part defining a sidewall, and a fluid port in said sidewall;

a cylindrical shell fittable around the reduced diameter part of said mandrel, and having an upper flange;

an upper thimble threadably engageable with said mandrel and engageable with the upper flange of said shell for fixing said shell to said mandrel, said upper thimble having a tapered surface;

an annular elastomeric band disposed around said shell and including an upper and lower annular tapered edge, said upper annular tapered edge engaging the tapered surface of said upper thimble;

a first cylinder piston fixed to said mandrel by a shearable device, said first cylinder piston including internal annular engaging teeth angled downwardly;

a second piston encircling the reduced diameter part of said mandrel and disposed generally between said mandrel and said first piston, said second piston including a shearable connection to said first piston, and further including downwardly angled engaging teeth formed on an outer surface thereof;

a ratchet ring disposed between said first piston and said second piston, and including inner and outer upwardly angled engaging teeth engaging with the respective engaging teeth of the second piston and said first piston to thereby provide a ratchet movement of said second piston with respect to said first piston;

a lower thimble fixed to an upper part of said second piston, said lower thimble having a tapered surface engageable with a tapered annular edge of said elastomeric band; and seal means for sealing said first and second pistons together and about said fluid port to thereby form a chamber such that in response to a first fluid pressure in said chamber the shearable connection between said first and second pistons is released and said second piston is moved in a direction for causing compression of said elastomeric band, and such that in response to a second greater fluid pressure in said chamber the shearable device between said first piston and said mandrel is released and said first piston is allowed to move in a direction opposite that of said second piston so that said elastomeric band is allowed to relax to thereby permit said packer to be moved in the casing.

28. The isolation packer of claim 27 wherein said elastomeric band defines a first band, and further including a second elastomeric band disposed around said shell, said first and second bands being constructed substantially identical.

29. The isolation packer of claim 28 further including a spacer disposed around said shell and between said first and second elastomeric bands, said spacer having upper and lower annular tapered edges engageable with the tapered annular edges of said first and second elastomeric bands.

30. A method for setting a packer in a production casing, comprising the steps of:

fixing the packer to a tubing string so as to communicate fluid pressure from the tubing string to the packer;

lowering the tubing string and the packer fixed thereto to a desired location within the casing;

pressurizing the tubing string with a hydraulic fluid to a first pressure for ratcheting a locking arrangement and causing an elastomeric element of said packer to expand and seal and lock said packer in a sealed condition in the casing;

removing the first pressure from the tubing string;

pressurizing the tubing string with a hydraulic fluid to a second higher pressure for releasing said locking arrangement and the seal of said packer from the casing; and withdrawing the tubing string and said packer fixed thereto from the casing.

31. The method of claim 30 further including plugging the tubing string at a lower location thereof for allowing the tubing string to be pressurized.

32. The method of claim 30 further including pressurizing the tubing string with the first pressure to operate a piston to cause said elastomeric element to expand.

33. The method of claim 30 further including maintaining said elastomeric element expanded after removal of the first pressure.

34. The method of claim 30 further including pressurizing the tubing string with the second pressure to operate another piston for releasing the seal of the elastomeric element to the casing.

35. A hydraulically operated isolation packer adapted for use in sealing a hydrocarbon production casing, comprising:

a mandrel having a bore therethrough for carrying hydraulic fluids;

elastomeric means encircling said mandrel and adapted to expand in response to a pressure applied thereto for sealing said packer within said production casing;

a piston responsive to a first fluid pressure in said mandrel for moving said piston such that said elastomeric means is expanded; and means comprising a ratchet arrangement for allowing one-way movement of said piston for locking said piston such that said elastomeric means remains expanded, said locking means being responsive to a second fluid pressure for releasing said piston to thereby allow said elastomeric means to contract and permit movement of said packer within said casing.

36. The isolation packer of claim 1 wherein said piston defines a first piston, and wherein said locking means includes a second piston releasably fixed to said mandrel and engageable with said first piston by a ratchet arrangement.

37. A method for setting a packer in a production casing, comprising the steps of:

fixing the packer to a tubing string so as to communicate fluid pressure from the tubing string to the packer;

lowering the tubing string and the packer fixed thereto to a desired location within the casing;

pressurizing the tubing string with a hydraulic fluid to a first pressure for causing an elastomeric element of said packer to expand and seal said packer and set said packer in the casing;

removing the first pressure from the tubing string;

pressurizing the tubing string with a hydraulic fluid to a second higher pressure for releasing the seal of said packer from the casing;

pressurizing the tubing string with the second pressure to operate another piston for releasing the seal of the elastomeric element to the casing; and withdrawing the tubing string and said packer fixed thereto from the casing.

38. The method of claim 37 further including shearing a connection of said another piston in response to the second pressure.

* * * * *